United States Patent [19]

Shimotori et al.

[11] 4,280,046

[45] Jul. 21, 1981

[54] SHEATH HEATER

[75] Inventors: Kazumi Shimotori, Kawasaki; Isao Izumi, Yokohama; Hideki Murabayashi, Kawasaki, all of Japan

[73] Assignee: Tokyo Shibaura Denki Kabushiki Kaisha, Kawasaki, Japan

[21] Appl. No.: 98,717

[22] Filed: Nov. 30, 1979

[30] Foreign Application Priority Data

Dec. 1, 1978 [JP] Japan ..... 53-148914

[51] Int. Cl.[3] ..... H05B 3/44

[52] U.S. Cl. ..... 219/544; 219/548; 219/552; 338/238; 338/257; 428/679; 428/680; 174/102 R

[58] Field of Search ..... 219/534, 540, 544, 552, 219/553; 338/230, 238, 257, 275, 264, 248; 29/613; 428/381, 384, 592, 632, 679, 680; 174/102 R

[56] References Cited

U.S. PATENT DOCUMENTS

| | | | |
|---|---|---|---|
| 1,736,745 | 11/1929 | Lohmann | 338/230 |
| 2,360,267 | 10/1944 | Osterheld | 338/268 X |
| 2,816,200 | 12/1957 | Mudge | 428/384 X |
| 3,121,154 | 2/1964 | Menzies et al. | 219/552 |
| 3,244,861 | 4/1966 | Colburn | 219/438 |
| 3,622,755 | 11/1971 | Vedder | 219/544 |

FOREIGN PATENT DOCUMENTS

| | | |
|---|---|---|
| 48-33172 | 11/1974 | Japan . |
| 50-42175 | 10/1976 | Japan . |
| 52-39548 | 4/1977 | Japan . |

OTHER PUBLICATIONS

Yajima et al., *Nihon Kinzoku Gakkai Shi,* "Some Experiments on Improvement of Electrical Heat Resisting Wire by Al Diffusion", (Report 2), vol. 19, p. 369, (1980).

Gulbransen et al., J. Electrochemical Soc., "Oxidation Studies on the Nickel-Chromium and Nickel-Chromium-Aluminum Heater Alloys," vol. 106, p. 941, Nov. 1959.

*Primary Examiner*—Volodymyr Y. Mayewsky
*Attorney, Agent, or Firm*—Oblon, Fisher, Spivak, McClelland & Maier

[57] ABSTRACT

A sheath heater having a heating wire embedded in a ceramic insulator such that the thermal deformation of the heating wire is substantially prevented, wherein the heating wire is formed of a nichrome-based wire having an Al-rich surface layer so as to permit forming an oxidation-protective alumina layer on the surface of the nichrome-based wire.

5 Claims, 3 Drawing Figures

SHEATH HEATER

This invention relates to a heater having a heating wire embedded in a ceramic insulator.

A heater having a heating wire embedded in a ceramic insulator such that the thermal deformation of the heating wire is substantially prevented by the insular, hereinafter referred to as "sheath heater", includes, for example, a rod-like heater and a planar heater. Compared with a naked wire heater, the sheath heater has an adequate heat capacity, a large heat transmitting area and a long life in continuous heating and, thus, is widely used as industrial and domestic heating apparatus.

A compact heater of high watt density type, which is frequently turned on and off repeatedly, is preferably used as a heater for preheating, for example, a molten sodium pipe of a fast breeder reactor or for preventing the freezing of the door of a train. Suppose the conventional sheath heater is used as such a heater. In this case, the heating wire of the sheath heater tends to be broken in a short period of time. Naturally it is a matter of serious concern in this field to produce a sheath heater having a long life and a high reliability even if the heater is frequently turned on and off repeatedly.

An object of this invention is to provide a sheath heater having a long life and a high reliability even under a severe condition that the heater is frequently turned on and off repeatedly.

According to this invention, there is provided a sheath heater having a heating wire embedded in a ceramic insulator such that the thermal deformation of the heating wire is substantially prevented, wherein the heating wire is formed of a nichrome-based wire having an Al-rich surface layer.

This invention can be more fully understood from the following detailed description when taken in conjunction with the accompanying drawings, in which.

Figure 1:
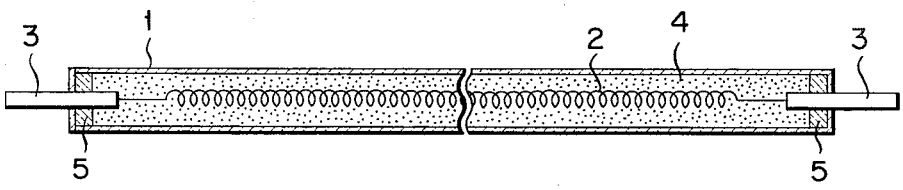
FIG. 1 is a cross sectional view showing a sheath heater according to one embodiment of this invention.

If a sheath heater is frequently turned on and off repeatedly, the heating wire of the sheath heater is eventually broken. The inventors have made researches on the cause of the breakage, finding out that the life of the sheath heater depends mainly on (1) the magnitude of the creep deformation of the heating wire, and (2) the oxidation resistance of the heating wire in the heating step.

The life of a bare heater depends mainly on the oxidation resistance of the heating wire. Thus, a sheath heater having the heating wire embedded in ceramics is somewhat superior to the bare heater in the oxidation resistance of the heating wire, because the heating wire is sealed out from oxidation atmosphere. It follows that the sheath heater is advantageous in life over the bare heater where the heater is kept turned on continuously. It has been found, however, that the life of the bare heater is longer than that of the sheath heater where the heater is frequently turned on and off repeatedly.

When the sheath heater has been turned on, the heating wire is rapidly heated, whereas, the temperature elevation of the sheath is considerably slower than that of the heating wire, resulting in a considerable temperature difference. Since the thermal deformation of the heating wire is obstructed by the sheath and the ceramics housed therein, the heating wire incurs a compression stress during the temperature elevation and a tensile stress during the temperature drop depending on the temperature difference mentioned above. Naturally, the thermal stress is exerted to the heating wire every time the sheath heater is turned on or off, resulting in that the thermal fatigue of the sheath heater is much greater than that of the bare heater where the heater is frequently turned on and off repeatedly.

It is supposed that the thermal fatigue makes the life of the sheath heater shorter than that of the bare heater in spite of the fact that the sheath heater is superior to the bare heater in the oxidation resistance of the heating wire.

To be brief, the sheath heater was generally thought to be inferior in life to the bare heater for the case of frequently turning the heater on and off. However, the present inventors have found it possible to make the life of the sheath heater markedly longer than that of the bare heater even if the heater is frequently turned on and off.

Specifically, a sheath heater of this invention comprises a nichrome-based heating wire having an Al-rich surface layer. Since the heating wire is embedded in a ceramic insulator, the Al-rich surface layer of the heating wire is converted into a stable alumina layer serving to suppress the oxidation of the nichrome-based wire itself. In addition, the creep strength of the nichrome-based wire is improved by being alloyed with aluminium. It follows that the life of the sheath heater is markedly improved in spite of the construction that the thermal deformation of the heating wire is obstructed by the ceramic insulator. As a matter of fact, the sheath heater of this invention exhibits a life much longer than that of the bare heater even if the heater is frequently turned on and off repeatedly.

The ceramic insulator used in this invention includes, for example, magnesia, boron nitride alumina, mullite, zirconia and silicon nitride. Particularly suitable for this invention is magnesia or boron nitride which exhibits a good insulation property.

The heating wire used in this invention is formed of a nichrome-based alloy consisting of, for example, 19 to 21% of Cr, at most 2.5% of Mn, 0.2 to 1.5% of Si, at most 0.15% C, at most 1% of Fe and the balance of Ni. The nichrome-based heating wire may be enabled to bear an Al-rich surface layer by, for example, a hot dipping method or a physical vapor deposition such as ion plating method. Incidentally, how to form such an Al-rich surface layer is described in detail in, for example, Japanese Patent Application Disclosure Nos. 49-120195 or 51-117129. The Al-rich layer may consist of Al alone or may contain Si together with Al as far as an alumina layer is formed on the surface of the heating wire prior to the actual use of the sheath heater.

Described in the following with reference to the accompanying drawing is an Example of this invention together with a control case.

EXAMPLE

An Al-rich layer about 3$\mu$ thick was formed by a hot dipping method on the surface of a heating wire having a diameter or 0.5 mm and formed of an alloy consisting of 19.6% of Cr, 0.08% of Mn, 0.20% of Fe, 0.05% of C and the balance of Ni, followed by preparing a coil having an outer diameter of 5 mm from the wire. Then, a sheath heater constructed as shown in FIG. 1 was prepared by using the coil of the heating wire. It is seen that a coil 2 of the heating wire and an insulator 4 of magnesia are housed in a sheath 1 having an outer diameter of 9 mm and formed of stainless steel type 304. The insulator 4 is loaded such that the density thereof is equal to 90% of the theoretical density. As shown in the drawing, lead wires 3,3 extending through insulation seals 5,5 are connected to the ends of the coil 2.

CONTROL

A sheath heater was prepared as in the Example described above except that an Al-rich layer was not formed on the surface of the heating wire.

The two binds of sheath heaters were turned on and off repeatedly under a watt density of 11 and 9 W/cm$^2$ in order to look into the number of on-off cycles causing breakage of the heating wire, each cycle consisting of 15 minutes of "on" time and 15 minutes of "off" time. Table 1 shows the results together with the mechanical properties of the heating wire.

TABLE 1

| | Properties of Heating Wire | | | Test Results | |
|---|---|---|---|---|---|
| | Tensile Strength (kg/mm$^2$) | 0.2% Yield point (kg/mm$^2$) | Elongation (%) | Watt Density (W/cm$^2$) | The number of on-off cycles |
| Example | 103 | 56 | 27 | 11 | 151 |
| | | | | 9 | 4100 |
| Control | 100 | 55 | 30 | 11 | 5 |
| | | | | 9 | 142 |

Table 1 shows that the heating wire of this invention is substantially equal to the conventional heating wire in mechanical properties. However, the sheath heater of this invention has a life about 30 times longer than that of the conventional sheath heater where the heater is frequently turned on and off.

An additional experiment was conducted for comparing the sheath heater and the bare heater. Specifically, two bare heaters prepared by using the heating wires included in the sheath heaters of the Example and Control described above were subjected to on-off operations under a watt density of 9 W/cm$^2$ in order to look into the number of on-off cycles causing breakage of the heating wire. As in the previous experiment, each cycle consisted of 15 minutes of "on" and 15 minutes of "off". Table 2 shows the results together with the results of the previous experiment applied to the sheath heaters.

TABLE 2

| | | The number of on-off cycles | Comparison with bare heater (%) |
|---|---|---|---|
| Example | Sheath heater | 4100 | + 363 |
| | Bare heater | 885 | |
| Control | Sheath heater | 142 | − 56.7 |
| | Bare heater | 342 | |

In the conventional sheath heater, the thermal deformation of the heating wire is obstructed by the ceramic insulator, resulting in that the sheath heater is inferior to the bare heater in life as shown in Table 2. In this invention, however, the sheath heater has a life markedly longer than that of the bare heater, in contrast to the general tendency of the convention sheath heater. As described previously, the heating wire included in the sheath heater of this invention is low in creep deformation and has an excellent resistance to oxidation. These properties of the heating wire are thought to have brought about the excellent result indicated in Table 2.

Figure 2:
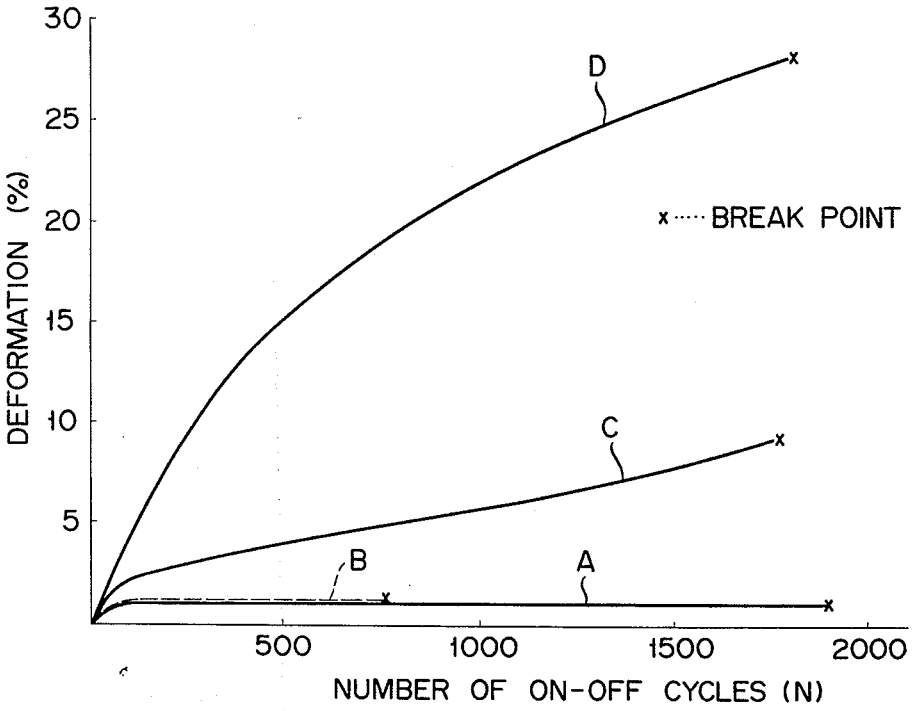
FIG. 2 is a graph of creep deformation relative to the number of on-off cycles applied to heating wires.

FIG. 2 shows the creep deformation of the heating wire relative to the number of on-off cycles applied to the heating wire. The creep deformation was determined by ASTM B76-65 (Accelerated Life Test of Ni—Cr and Ni—Cr—Fe alloys for Electric Heating). Curves A and B (broken line) shown in FIG. 2 represent the heating wires included in the sheath heaters of the Example and Control described previously, respectively. On the other hand, curves C and D denote heating wires of reference cases formed of an alloy of 25Cr—5Al—Fe and an alloy of 24Cr—5.5Al—1.5Co—Fe, i.e., "Kanthal A-1" produced by Kanthal Inc., Sweden, respectively. It is clearly seen from FIG. 2 that the heating wire of Fe—Cr—Al alloy, which is superior in general to the nichrome wire in oxidation resistance, bears a marked creep deformation. It is also seen that the nichrome-based heating wire used in the Control (broken line B) has a markedly short life, though the creep deformation thereof is low. In contrast, the heating wire used in the sheath heater of this invention, i.e., a nichrome-based wire having an Al-rich surface layer, is low in creep deformation and has a long life (see curve A of FIG. 2).

Figure 3:
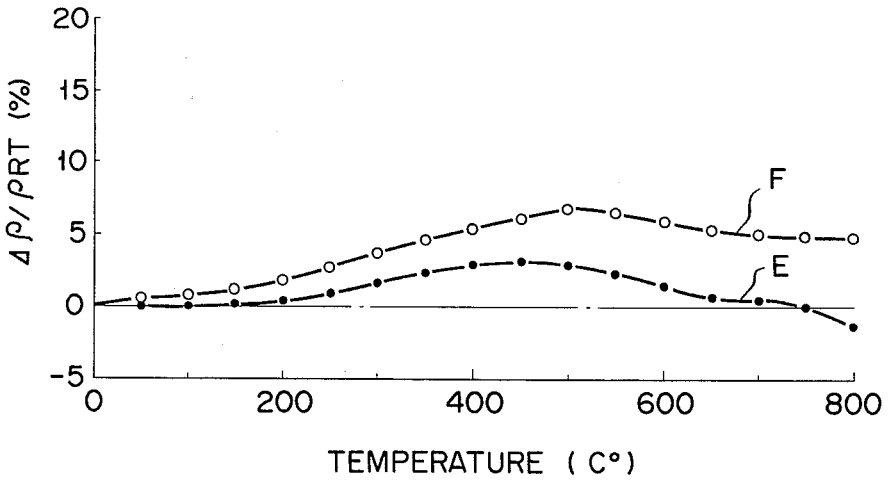
FIG. 3 is a graph of resistivity relative to temperature with respect to the invented sheath heater and the conventional sheath heater.

Further, the sheath heaters of the Example and Control were used for preheating a molten sodium pipe of a liquid metal fast breeder reactor (LMFBR). For the preheating, the heating wires of the sheath heaters were set at 600° C. It was found that the life of the sheath heater of this invention was about 30 times longer than that of the conventional sheath heater. An additional experiment was conducted for examining the relationship between resistivity ($\rho$) and temperature for each of the sheath heater of the Example and Control, since a uniform heating is important in such a molten sodium pipe. FIG. 3 shows the results. Curves E and F shown in FIG. 3 represent the sheath heaters of the Example and Control, respectively. It is clearly seen that the sheath heater of this invention is very small in variation of resistivity under temperatures ranging between 20° C. and 800° C., compared with the conventional sheath heater.

In the embodiment described herein, the technical idea of this invention is applied to a rod-like sheath heater. But, the technical idea of this invention can also be applied to a planar sheath heater.

As described above in detail, this invention provides a sheath heater comprising a heating wire formed of a nichrome-based wire having a Al-rich surface layer. It is important to note that the Al-rich surface layer is converted into a stable alumina layer. It follows that the heating wire is enabled to exhibit an improved resistance to oxidation. In addition, the aluminium surface layer serves to enhance the merit of the nichrome-based wire, i.e., small creep deformation. Naturally, the heating wire embedded in a ceramic insulator exhibits an improved ability to withstand heating-cooling cycles, resulting in that the sheath heater of this invention has a life about 30 times longer than that of the conventional heater. An additional merit to be noted is that the sheath heater of this invention permits a uniform heating.

What is claimed is:

1. A metal sheath heater having a coiled heating wire embedded in a ceramic insulator, enclosed in said sheath, such that the thermal deformation of the heating wire is is substantially prevented by the insulator, characterized in that the heating wire is formed of a nichrome-based wire having an Al-rich surface layer which is converted into alumina by thermal oxidation and alloyed with the nichrome-based wire wherein the Al-rich surface layer is formed by a hot dipping on the surface of the nichrome-based wire.

2. The sheath heater according to claim 1, wherein the heating wire is formed of a nichrome-based alloy consisting of 19 to 21% of Cr, at most 2.5% of Mn, 0.2 to 1.5% of Si, at most 0.15% of C, at most 1% of Fe and the balance of Ni.

3. The sheath heater according to claim 1, wherein the ceramic insulator is selected from the group consisting of magnesia and boron nitride.

4. The sheath heater according to claim 1, wherein the Al-rich layer consists of Al alone.

5. The sheath heater according to claim 1, wherein the Al-rich layer contains Si.

* * * * *